United States Patent [19]

Stedman et al.

[11] 4,197,049

[45] Apr. 8, 1980

[54] EJECTOR ASSEMBLY HAVING A PIVOTAL UPPER MEMBER

[75] Inventors: Robert N. Stedman, Chillicothe; James E. Gee, Washington, both of Ill.

[73] Assignee: Caterpillar Tractor Co., Peoria, Ill.

[21] Appl. No.: 890,722

[22] Filed: Mar. 20, 1978

[51] Int. Cl.[2] ..... E02F 3/85

[52] U.S. Cl. ..... 414/493; 37/126 AE; 414/517

[58] Field of Search ..... 214/82, 146 E, 510; 37/124, 129, 126 AB, 126 AE; 414/509, 511, 513, 516, 725, 726, 492, 493

[56] References Cited

U.S. PATENT DOCUMENTS

| | | | |
|---|---|---|---|
| 3,176,863 | 4/1965 | Kuhl | 214/146 |
| 3,486,251 | 12/1969 | Carston | 214/82 X |
| 3,523,621 | 8/1970 | Anderson | 37/118 |
| 3,543,960 | 12/1970 | Wagner | 214/767 |
| 3,675,347 | 7/1972 | Stewart | 37/129 |
| 3,690,480 | 9/1972 | Heine | 214/82 X |
| 3,837,516 | 9/1974 | Meyer | 214/82 X |
| 4,041,625 | 8/1977 | Fisher | 214/82 X |

*Primary Examiner*—Stephen G. Kunin
*Assistant Examiner*—Terrance L. Siemens
*Attorney, Agent, or Firm*—John W. Grant

[57] ABSTRACT

A self loading scraper has upper and lower members of an ejector pivotally interconnected at a pivot. The upper member is automatically pivoted about the pivot rearwardly relative to the lower member as the ejector is moved forwardly for ejecting the load from the bowl.

11 Claims, 3 Drawing Figures

23
21
26
54
56
31
57
58
53
44
59
38
11
43
61
36
13
41
39
32
12
37
42
17

EJECTOR ASSEMBLY HAVING A PIVOTAL UPPER MEMBER

BACKGROUND OF THE INVENTION

This invention relates to an ejector assembly for a self loading scraper and more particularly to a two-piece ejector with means to automatically pivot the upper member rearwardly in response to forward movement of the ejector.

Some self loading scrapers have one or more augers positioned vertically within the scraper bowl adjacent the cutting edge for assisting in the loading of material into the bowl. Although the augers have proven to be effective in loading the material into the scraper bowl, they have reduced the effectiveness of unloading the material from the bowl. Normally, a bulldozer type ejector is used and since the augers are positioned at the forward end of the bowl, the material must be pushed thorugh and around the augers by the ejector. In certain soils or materials and conditions, the ejection forces increase drastically and the ejection of the load is inefficient.

In some auger scraper designs, the bottom of the auger or augers is pivoted forwardly in response to forward movement of the ejector. However, with this arrangement, the size of the augers has generally been limited to a relatively small diameter. This is due to the fact that relatively large diameter augers interfer with the top portion of the ejector during the ejection cycle. Such interference prevents the ejector from being moved sufficiently forward to complete ejection of the load. If all the material is not unloaded during the unloading cycle, the effective net payload of the scraper is reduced.

SUMMARY OF THE INVENTION

The present invention is directed to overcoming one or more of the problems as set forth above.

According to the present invention, there is provided an ejector assembly having upper and lower members pivotally connected to one another by a hinge pin. A means automatically pivots the upper member about the hinge pin rearwardly relative to the lower member in response to the ejector being moved from a first position at the rearward end of the bowl to a second position at the forward end of the bowl.

DETAILED DESCRIPTION

Figure 2:
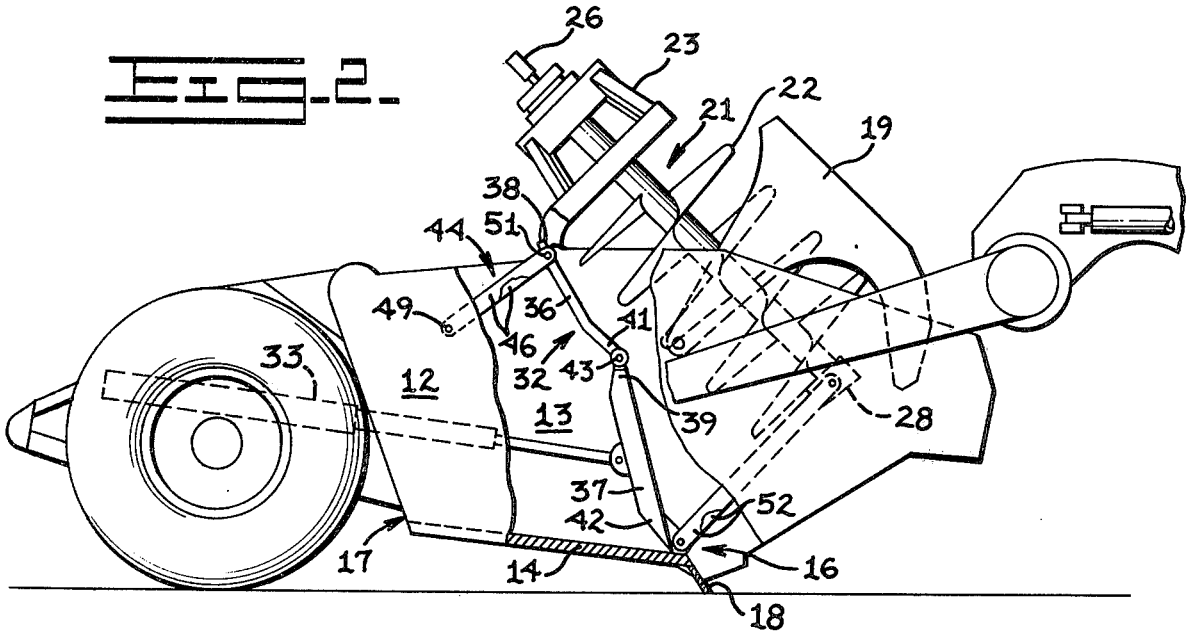
FIG. 2 is a side elevational view partially in section of the ejector assembly at a second position.

Referring to the drawings, a self loading scraper 10, as is known in the art, generally has an elongate bowl 11 formed by a pair of opposed sidewalls 12, 13 and a floor 14 extending between and interconnecting the bottom edge portions of the sidewalls. The bowl has forward and rearward ends 16, 17, respectively. A cutting edge 18 is secured to the forward end of the floor. An apron 19 is pivotally connected to the sidewalls for normally closing the forward open end of the bowl 11. Suitable means, not shown, is normally provided for moving the apron to an open position as shown in FIG. 2 for loading and unloading of the bowl.

An auger assembly 21, as is known in the art, has a vertically extending auger 22 positioned within the bowl at the forward end thereof. The upper end of the auger is rotatably connected to a support structure 23 which is in turn pivotally connected to the sidewalls 12, 13 of the bowl 11 by a pair of pins, one shown at 24. A hydraulic motor 26 is mounted on the support structure and is drivingly connected to the auger 22. The lower end of the auger is journalled for rotation in a bearing assembly, not shown, secured to the mid portion of a cross plate 28 normally positioned adjacent the cutting edge 18.

An ejector mechanism 31 has an ejector assembly 32 slidably positioned within the bowl 11 between the sidewalls 12, 13 and is movable between a first position adjacent the rearward end 17 of the bowl and a second position adjacent the forward end 16 of the bowl. A hydraulic jack 33 is connected to the ejector assembly 32 for moving the ejector assembly between the first and second positions.

The ejector assembly 32 includes upper and lower members 36, 37 each having upper edge portions 38, 39, respectively, and lower edge portions 41, 42, respectively. The lower edge portion 41 of the upper member 36 is hingedly connected to the upper edge portion 39 of the lower member 37 by a hinge pin 43. The hydraulic jack 33 is connected to the lower member 37. Suitable guide means, not shown, are connected to the lower member 37 for maintaining it at a fixed attitude relative to the floor 14 as the ejector assembly is moved between the first and second positions.

A means 44 is provided for automatically pivoting the upper member 36 about the hinge pin 43 rearwardly relative to the lower member 37 in response to the ejector assembly 32 being moved from the first position to the second position.

The means 44 can be, for example, a pair of elongate links 46, each having first and second end portions 47, 48. A pair of pivot pins, one shown at 49, pivotally connect the first end portions of the links to the sidewalls 12, 13. A pair of pivot pins, one shown at 51, pivotally connect the second end portions of the links to the upper edge portion 38 of the upper member 36.

The pins 51 are spaced a first distance $D_1$ from the hinge pin 43 and a second distance $D_2$ from pins 49 with $D_1$ being substantially equal to $D_2$. The pins 43 and 49 are positioned in a plane substantially parallel to the floor 14.

A pair of links 52 connect the lower edge portion 42 of the lower member 37 to the ends of cross plate 28 for moving the auger assembly 21 to the second position in response to the ejector assembly being moved to its second position.

Figure 1:
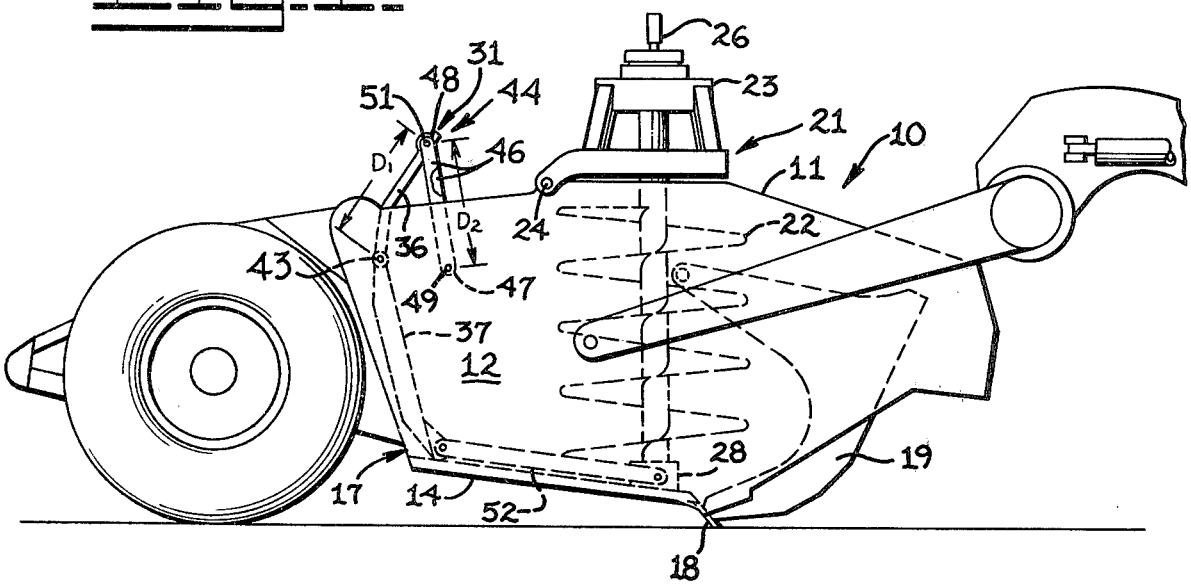
FIG. 1 is a side elevational view of an ejector assembly of the present invention at a first position.

In use, extension of the hydraulic jack 33 moves the lower member 37 of the ejector assembly 32 forwardly from its position shown in FIG. 1 toward the position shown in FIG. 2. This moves the hinge pin 43 forwardly resulting in the link 46 pivoting about the pin 49 and the pin 51 moving in an arcuate pathway about pin 49. The arcuate movement of links 46 causes the upper member 36 to pivot about the hinge pin 43 rearwardly relative to the lower member 37 to the position shown in FIG. 2.

The ejector assembly 32 is returned to its rearward position by retracting the hydraulic jack 33.

Figure 3:
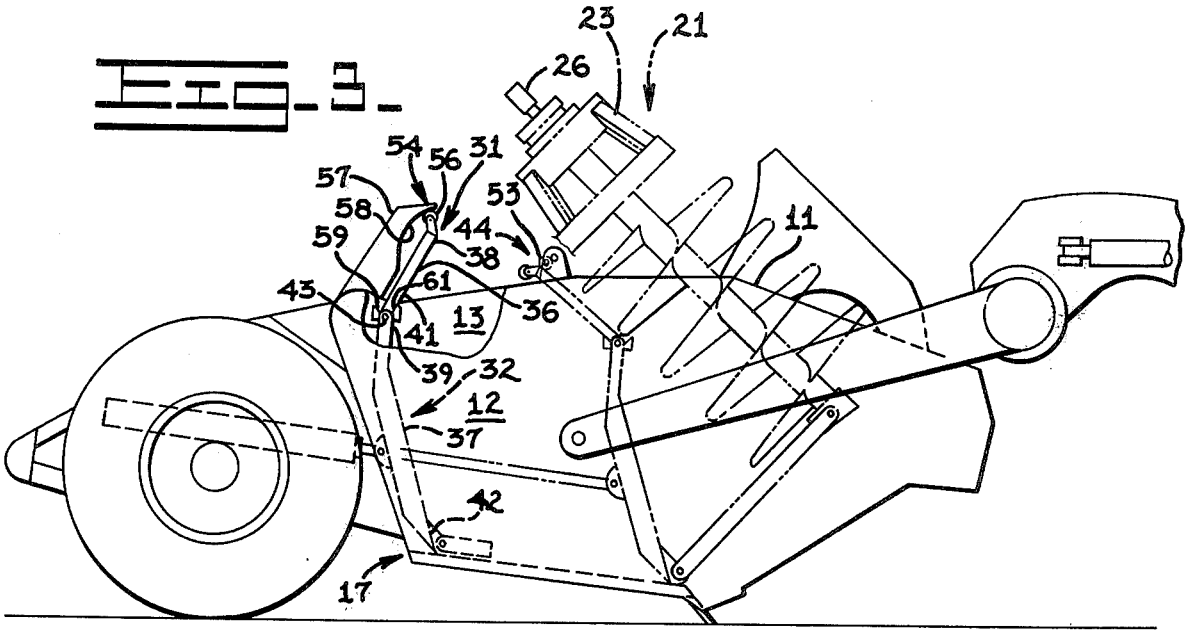
FIG. 3 is a side elevational view of an alternate embodiment of the ejector assembly.

An alternate embodiment of the ejector assembly having a pivotal upper member of the present invention is disclosed in FIG. 3. It is noted that the same reference numerals of the first embodiment are used to designate similarly constructed counterpart elements of this embodiment. In this embodiment, however, the automatic pivoting means 44 can be for example a pair of rollers, one shown at 53 rotatably connected to the sidewall 13 in the pathway of the upper member 36 of ejector assembly 32 for engagement with the upper member as the ejector assembly is moved toward its second position and prior to the ejector assembly reaching the second position.

A second means 54 automatically pivots upper member 36 about hinge pin 43 forwardly relative to lower member 37 in response to the ejector assembly 32 being moved from the second position to the first position.

The second means 54 can be, for example, a second roller 56 rotatably connected to the upper edge portion 38 of upper member 36 and a guide cam 57 connected to the scraper bowl 11 rearwardly of ejector assembly 32 and positioned in the pathway of the second roller. The guide cam has a guide surface 58 provided thereon.

A first stop means 59 is connected to the upper edge portion 39 of lower member 37 for engagement with the upper member 36 for limiting the rearward pivoting of the upper member relative to the lower member. A second stop means 61 is connected to the upper edge portion 39 of the lower member 37 for engagement with upper member 36 for limiting the forward pivoting of the upper member relative to the lower member.

In the use of the alternate embodiment, as the ejector assembly 32 is moved forwardly towards its second position, the upper member 36 engages the rollers 53 which cause the upper member to be pivoted rearwardly about the hinge pin 43. The first stop means 59 limits the rearward pivoting of the upper member.

As the ejector assembly 32 is moved rearwardly to its first position, the second roller 56 engages the guide surface 58 of guide cam 57, thereby pivoting the upper member 36 forwardly about the hinge pin. The second stop means 61 limits the forward pivoting of the upper member.

In view of the foregoing, it is readily apparent that the structure of the present invention provides an improved ejector mechanism having a hinged two-piece ejector assembly and means for pivoting the upper member rearwardly relative to the lower member in response to the ejector being moved forwardly in the scraper bowl. By pivoting the upper member rearwardly, in response to forward movement of the ejector assembly, the lower member can be moved forwardly sufficiently for ejecting all material from the bowl while providing sufficient clearance at the upper portion for the employment of a larger diameter auger.

Other aspects, objects and advantages of this invention can be obtained from a study of the drawings, the disclosure and the appended claims.

The embodiments of the invention in which an exclusive property or privilege is claimed are defined as follows:

1. An ejector mechanism for a self loading scraper having an elongate bowl, said bowl having forward and rearward ends, a pair of spaced sidewalls, and a floor interconnecting the bottom edge portion of the sidewalls, comprising:

an ejector assembly having upper and lower members and a hinge pin hingedly connecting the upper member to the lower member, said ejector assembly being slidably positioned within the bowl between the sidewalls and both the upper and lower members being translatable relative to the sidewalls between a first position adjacent the rearward end and a second position adjacent the forward end; and means for automatically pivoting the upper member about the hinge pin rearwardly relative to the lower member in response to the upper and lower members of the ejector assembly being translated from the first position to the second position.

2. The ejector mechanism of claim 1 wherein said means is connected to at least one sidewall forwardly of the ejector assembly at the first position of the ejector assembly.

3. The ejector mechanism of claim 2 wherein said means includes an elongate link having first and second end portions, a first pivot pin pivotally connecting the first end portion of the link to one sidewall of the bowl, and a second pivot pin pivotally connecting the second end portion of the link to the upper member.

4. The ejector mechanism of claim 3 wherein said second pivot pin is spaced a first distance from the hinge pin and a second distance from the first pivot pin, said first and second distances being substantially equal, said hinge pin and said first pivot pin being positioned in a plane substantially parallel to said floor.

5. The ejector mechanism of claim 2 wherein said means includes a roller rotatably connected to the sidewall in the pathway of the upper member for engagement therewith prior to the ejector assembly reaching said second position.

6. The ejector mechanism of claim 5 including first stop means for limiting the rearward pivoting of the upper member relative to said lower member.

7. The ejector mechanism of claim 5 including second means for automatically pivoting the upper member about said hinge pin forwardly relative to the lower member in response to the ejector assembly being moved from the second position to the first position.

8. The ejector mechanism of claim 7 wherein said second means includes a second roller rotatably connected to the upper edge portion of the upper member and a guide cam connected to the scraper bowl rearwardly of the ejector assembly and positioned in the pathway of the second roller.

9. The ejector mechanism of claim 8 including second stop means for limiting the forward pivoting of the upper member relative to said lower member.

10. An ejector mechanism for a self loading scraper having an elongate bowl, said bowl having forward and rearward ends, a pair of spaced sidewalls, and a floor interconnecting the bottom edge portion of the sidewalls, comprising:

an ejector assembly having upper and lower members and a hinge pin hingedly connecting the upper member to the lower member, said ejector assembly being slidably positioned within the bowl between the sidewalls and being movable between a first position adjacent the rearward end and a second position adjacent the forward end;

means for automatically pivoting the upper member about the hinge pin rearwardly relative to the lower member in response to the ejector assembly being moved from the first position to the second position, said means including an elongate link having first and second end portions, a first pivot pin pivotally connecting the first end portion of the link to one sidewall of the bowl forwardly of the ejector assembly at the first position of the ejector assembly, and a second pivot pin pivotally connecting the second end portion of the link to the upper member.

11. The ejector mechanism of claim 10 wherein said second pivot pin is spaced a first distance from the hinge pin and a second distance from the first pivot pin, said first and second distances being substantially equal, said hinge pin and said first pivot pin being positioned in a plane substantially parallel to said floor.

* * * * *